US011766600B2

(12) United States Patent
Welsh

(10) Patent No.: US 11,766,600 B2
(45) Date of Patent: Sep. 26, 2023

(54) SKI POLE EQUIPMENT SECUREMENT DEVICE

(71) Applicant: Christopher John Welsh, Lahaina, HI (US)

(72) Inventor: Christopher John Welsh, Lahaina, HI (US)

( * ) Notice: Subject to any disclaimer, the term of this patent is extended or adjusted under 35 U.S.C. 154(b) by 259 days.

(21) Appl. No.: 16/756,123

(22) PCT Filed: Mar. 13, 2019

(86) PCT No.: PCT/US2019/022091

§ 371 (c)(1),
(2) Date: Apr. 15, 2020

(87) PCT Pub. No.: WO2019/178258

PCT Pub. Date: Sep. 19, 2019

(65) Prior Publication Data

US 2021/0370159 A1 Dec. 2, 2021

Related U.S. Application Data

(60) Provisional application No. 62/642,246, filed on Mar. 13, 2018.

(51) Int. Cl.
*A63C 11/02* (2006.01)
*A45C 13/30* (2006.01)

(52) U.S. Cl.
CPC ..... *A63C 11/021* (2013.01); *A45C 13/30* (2013.01)

(58) Field of Classification Search
CPC ..... A45C 13/30; A63C 11/021; A63C 11/025
See application file for complete search history.

(56) References Cited

U.S. PATENT DOCUMENTS 3,976,234 A * 8/1976 Moudry ..... B65D 63/10 24/302
D288,032 S * 2/1987 Gainey ..... D3/259

* cited by examiner

*Primary Examiner* — Sue A Weaver
(74) *Attorney, Agent, or Firm* — Donn K. Harms

(57) ABSTRACT

A ski equipment securement device having a body formed by a C-shaped member is adapted for removable engagement to a pair of snow skis and the poles used with the skis. A strap is engageable around the skis and to both ends of the body forming the C-shaped member to hold the skis adjacent and in a connection to the securement device. An opening in the body of the C-shaped member is sized to hold one or both ski poles and forms a handle to carry the engaged ski equipment.

20 Claims, 2 Drawing Sheets

SKI POLE EQUIPMENT SECUREMENT DEVICE

This application claims priority to U.S. Provisional Patent Application Ser. No. 62/642,246 filed on Mar. 13, 2018 which is incorporated herein in its entirety by this reference thereto.

1. FIELD OF THE INVENTION

The present invention relates generally to the transport of snow skiing equipment such as skis and poles. More specifically, the disclosed invention concerns a securement device adapted for engagement to and securement of skis and poles which provides the user an ability to transport the skis and poles as a unit with greater ease.

2. PRIOR ART

During trips to and from the ski slopes, snow skiers must carry their skis and poles across parking lots and sidewalks, and other areas, on their way to the slopes, and at the end of a long day back to their vehicle and evening accommodations. By their nature, elongated snow skis and the ski poles used with them, are ungainly and hard to hold in the hands of the user. This task is made harder by the need to wear gloves in cold climates as well as the damp and cold nature of the skis and poles, especially after use on the slopes.

During transport to and from ski slope areas, it is common that skiers must walk from parking lots for long distances to either the slopes or a bus providing transport to the slopes. Maintaining the skis and poles, which by their elongated nature, are continually moving independently from each other, becomes an arduous task. This task becomes harder as the duration of transport of the equipment due to the weight and long length of a typical pair of disconnected skis. This carrying task increases in difficulty where a skier is tasked with carrying their own skis and poles as well as those of a child or ski buddy.

Conventionally, skiers will carry a pair of skis by grasping a first end of the disconnected pair of skis in one hand to try and maintain them adjacent. The mid portion of the skis will then be supported on the shoulder. While compressing the two skis against each other with the first hand, the skier must hold the two ski poles in the other hand which may also be grasping the ski boots to be worn while skiing.

As can be discerned, carrying heavy skies, poles, and boots and selected hands while attempting to maintain the skis adjacent and balanced on the shoulder, is a tiring task. This is especially true when required over long distances walking and riding on buses. Still further, once in the ski lodge, skiers must navigate ice laden steps and pathways in crowded or confined areas carefully to avoid contact with other skiers and their equipment. With both hands required to hold the skiing equipment in this conventional fashion, frequently skiers are left with little or no ability to employ a hand to steady themselves using hand rails adjacent stairs and icy pathways.

Attempts to lessen the issues of carrying ungainly ski equipment over such distances and hazardous terrain have been tried in the past. For example, bags are used frequently in which the loose poles and skis are confined, and the bag is then carried using an exterior strap. However, once at the slopes, the skier must find a secure place to store the bag while the equipment is being used on the slopes.

The device herein disclosed, is adapted for easy yet secure removable engagement to snow skis and poles used throughout the world in alpine and cross country skiing. It is adapted to compressibly engage both skies to each other as well as to secure the two ski poles adjacent to the two skis in a fashion forming a handle from the two poles allowing for easy carrying of the engaged equipment either in horizontal or vertical disposition. This easy carrying is accomplished with one hand, leaving the other hand free for hand rails or for carrying a second set of equipment such as that of a child. Upon arrival at the ski slopes, the device is easily disengaged and stored in a pocket alleviating the need to rent a locker.

The forgoing examples of related art concerning snow skiing equipment and limitations related therewith are intended to be illustrative and not exclusive, and they do not imply any limitations on the invention described and claimed herein. Various other limitations of the related art are well known or will become apparent to those skilled in the art upon a reading and understanding of this specification and the accompanying drawings.

SUMMARY OF THE INVENTION

The shortcomings of prior art are overcome by the disclosed securement device herein. The device in all modes includes a strap extending from an engagement at a first end to a curved member or substantially C-shaped member, to an engagement of a second end of the strap to a clip. By substantially C-shaped member is meant any curved member extending along a length of a first section and around a curved area to a second section which extends a second length to a distal end. This curved shape or substantially C-shaped member extending along the first section and around the curved area and along the second section to a distal end, defines an opening accessible through a passage adapted for positioning of portions of ski poles therein.

Additionally, the term clip is used for convenience herein, in the depictions showing a curved or hook-like fastener engaged to the second end of the strap. However, a clip may be any first fastener which is adapted for a removable connection to a mating fastener, located on the C-shaped member or the strap immediately adjacent the C-shaped member. Thus, while shown as a hook-like clip, such should thus not be considered limited in any fashion as other removably engageable mating fasteners may be employed such as snaps, buttons, hooks, hook and loop material, or other fasteners as would occur to those skilled in the art. Currently, the hook-like clip is a preferred mode due to the ease of connection to the clip connector positioned on or adjacent the C-shaped member.

The device in all modes herein includes at least a portion of the strap being formed of elastic material to provide a biasing force when the strap of the device is positioned to a stretched engagement encircling ski equipment. The biasing force from the elongated elastic material forms a compressed contact against the exposed surfaces of adjacently positioned skis thereby enhancing the frictional contact of the strap in contact with the skis.

In a preferred mode of the device, a second portion of the strap may be formed of non-elastic material such as nylon or polyester or other woven or non woven belt or strap material such that it maintains substantially a fixed length. It should be noted that the strap may be formed entirely of elastic material where the first portion runs the entire length of the strap or could be formed entirely of non-elastic material, as with the included ramp described herein, will still provide significant enhancement to a strapped engagement with skis and poles. However, it was found in experimentation that forming the strap with a first portion which is elastic and second portion which is substantially fixed in length provided a more durable device and enhanced the frictional engagement of both the elastic and non elastic material with the exterior surfaces of skis.

Particularly preferred in all modes of the device is the inclusion of a formed ramp, on the exterior surface of the C-shaped member which is opposite the interior surface surrounding the opening. This ramp is formed by a recess in the exterior surface and may include shoulders on opposing sides. So configured, this forms a pathway or area for secure positioning of the strap within the recess and prevents it from sliding off once the device is encircled around skis and poles in an engaged position.

In a method of use, the device is posited with portions of both ski poles located within the opening and with a member section of the C-shaped member in contact with side surfaces of two skis which are placed with their smooth snow-contacting surfaces in contact with each other. Next, the user pulls the strap around to encircle the exposed surfaces of the skis and the clip is engaged to the clip connector to hold the device in the engaged position. Where elastic forms a portion of the strap, the stretching of the elastic imparts a biasing force to the strap which causes it to contact against the exterior of the skis in a biased contact.

The pulling of the strap to encircle and contact against the skis also positions a portion of the strap across the passage allowing the poles to enter and exit the opening, thereby holding the poles engaged within the opening. Further, where the C-shaped member is formed of pliable material allowing for a slight deflection of the first member section extending from the distal end of the C-shaped member, this deflection lessens the diameter of the opening and may provide for a compressive contact of the first and second member sections against the surfaces of the poles which prevent sliding.

Once the device is placed in this engaged position, the user may employ the poles engaged through the opening as a handle to carry the skis. As is well known but not shown herein, ski poles have loops thereon employed to hold the poles engaged to the wrists of the user while skiing. These loops may be placed to encircle the two skis prior to placing the device in the engaged position to thereby provide a secure mount of the handle ends of the poles to the skis once the device is placed in the engaged position.

The device is easily removed by disengaging the clip from the clip connector and removing the poles from the opening by sliding them through the passage in the substantially C-shaped member.

With respect to the above description of the ski equipment securement device, before explaining at least one preferred embodiment of the herein disclosed invention in detail, it is to be understood that snow ski equipment invention is not limited in its application to the details of construction and to the arrangement of the components or steps noted in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed removably engageable ski equipment securement device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the present invention to provide an improved carrying device for transporting elongated ski equipment in a hands-free manner, where the elongated ski equipment comprises a snowboard as well as a ski or a pair of skis.

It is a further object of the present invention to provide a device to removably engage snow skis and poles in adjacent stable positions, to allow for easy carrying and transport of the ski equipment.

It is an additional object of this invention to provide such a removably engageable ski and pole securement device which, once removed, may be stored in a clothing pocket easily.

A still further object of this invention is the provision of such a ski and pole securement device, which securely positions the skies adjacent the ski poles and thereby forms a handle from the ski poles allowing for carrying the engaged equipment in either of a vertical or horizontal disposition.

Other objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features of the ski equipment securement device herein. It is intended that the embodiments and figures disclosed herein are to be considered illustrative rather than limiting. In the drawings.

Figure 1:
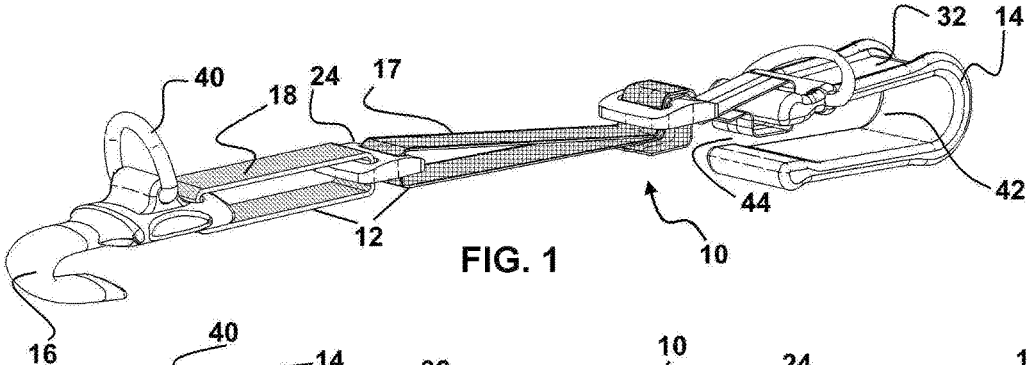
FIG. 1 depicts a perspective view of the ski equipment securement device showing a strap having a first portion engaged with a substantially C-shaped member and a second portion thereof attached to a clip which is removably engageable to a connector on the C-shaped member.

Other aspects of the present invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only. Such prepositions are not intended to be limiting or to imply that the device has to be used or positioned in any particular orientation.

Now referring to drawings in FIGS. 1-5, there is seen in FIG. 1 a perspective view of the ski equipment securement device 10 in a disengaged configuration. As shown, the device 10 in all modes includes a strap 12 extending from an engagement at a first end to a C-shaped member 14, to an engagement of a second end of the strap 12 to a clip 16. While the clip 16 is shown as a hook-like fastener, it may be any fastener which is adapted for a removable connection to a mating fastener located on the C-shaped member 14 or on the strap 12 adjacent the C-shaped member 14. As depicted the fastener is shown as the hook-like clip 16 and the mating fastener is shown as a ring-like clip connector 40. However, such should not be considered in any fashion as other fasteners removably engageable to mating fasteners may be employed such as snaps, buttons, hooks, hook and loop material, or fasteners as would occur to those skilled in the art.

Figure 5:
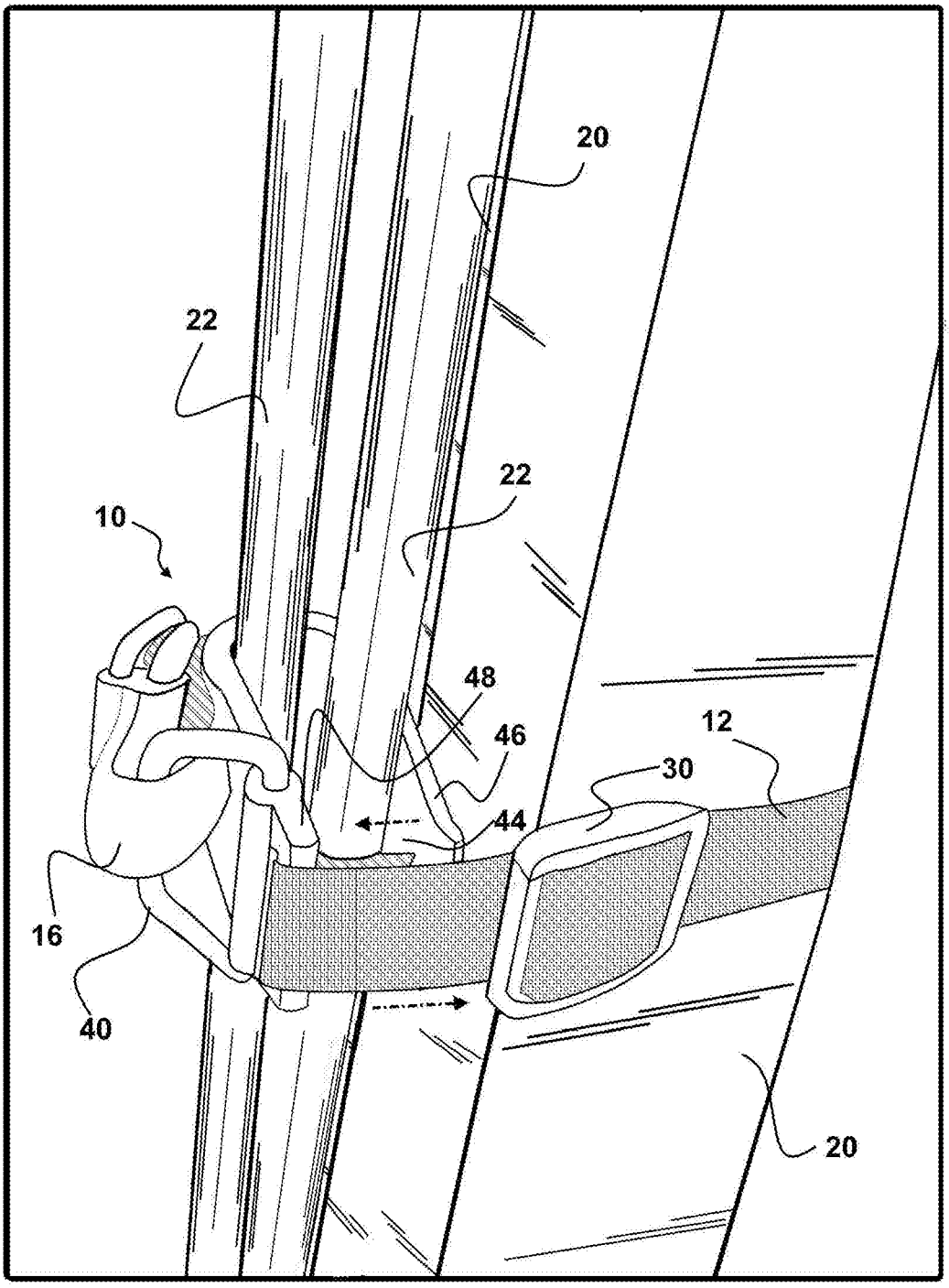
FIG. 5 shows the device of FIGS. 1-4 positioned in an engaged position with the elastic portion of the strap exerting a biasing force to hold the two skis in fixed positions relative to each other, and concurrently hold the poles within a ski pole clamp area within the C-shaped member.

As shown in all figures herein, at least a first portion 17 of the strap 12 is formed of elastic material. Elastic strap material is preferred for at least a portion of the strap 12 to provide a biasing force when the strap 12 of the device 10 is in a stretched engagement encircling ski equipment such as skis 20 and poles 22 (FIG. 5). The provided biasing force from the elongated elastic material, better holds the compressed contacting surfaces of adjacently positioned skis 20 stationary relative to each other. The biasing force also enhances the frictional contact of the strap 12 where it contacts surfaces of the skis 22, to better hold the strap 12, and the engaged device 10, in a fixed position encircling the two skis 20. A second portion 18 of the strap 12 may be formed of non-elastic material such as nylon or polyester or other woven or non woven belt or strap material such that it maintains substantially a fixed length. By substantially is meant that when stretched the second portion 18 maintains its non stretched length plus or minus 10 percent.

Figure 4:
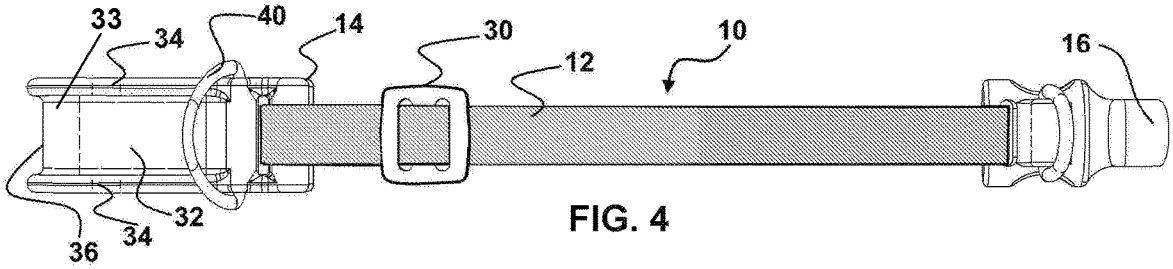
FIG. 4 depicts another mode of the device herein substantially the same as that of FIG. 1-3 where the strap is formed entirely of elastic material.

While the strap 12 may be formed entirely of elastic material where the first portion 17 of the strap 12 runs the entire length of the strap 12 such as in FIG. 4, it was found in experimentation that forming the strap in a first portion 17 which is elastic and second portion 18 which is substantially fixed in length, and non-elastic, provided a more durable device 10, which better frictionally engaged around the exterior surfaces of skis 20 to which it is adapted to circumferentially engage.

While it was originally thought that the strap 12 entirely of elastic material would work better to hold the device 10 and skis 20 stationary, unexpectedly in experimentation it was found that the non-elastic second portion 18 when used, maintained the position of the device 10 better when circumferentially contacting the surfaces of adjacent skis 20 when engaged as in FIG. 5. As such, the device 10 adapted for engagement around adjacent skis 20 and poles 22 in all modes has at least a first portion 17 of the strap 12 formed of elastic material, and preferably has a second portion 18 of the strap 12 formed of material which is substantially fixed in length.

Figure 2:
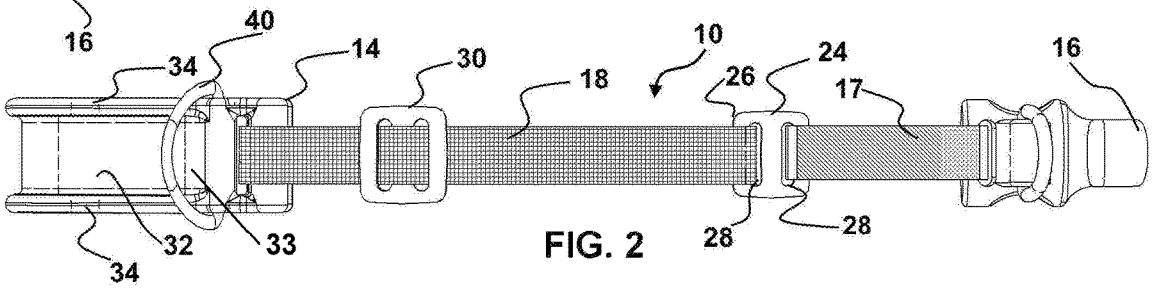
FIG. 2 depicts an overhead view of the device as in FIG. 1.

Shown in FIG. 2, is an overhead view of a particularly preferred configuration of the device 10 where the first portion 17 of the strap formed of elastic material is engaged between the clip 16 and a connection point 24 at a second end of the second portion 18 of the strap 12. While this connection point 24 is shown as a connecting member 26 with two openings 28 at opposing ends, it might also be formed by sewing, riveting, or other connections between the second end of the second portion 18 of the strap 12 and one end of the first portion 17 of the strap 12.

As shown in FIG. 2, the employment of a connecting member 26 with openings 28 at opposing ends, allows the elastic first portion 17 of the strap 12 to be formed of two sections 17*a* and 17*b*, thereby doubling the biasing force of the elastic first portion 17 of the strap 12. This configuration also allows the second portion 18 of the strap 12 to form a looped connection through the opening 28 of the connecting member 26, and engage a distal end of the second portion 18 of the strap 12 with an adjustment member 30. This adjustment member 30 provides for a length adjustment of the second portion 18 of the strap, between a first end thereof engaged with the C-shaped member 14 and the second end thereof engaged to one end of the elastic first portion 17 of the strap 12.

Additionally shown in FIG. 2, and other figures herein, is a curved recessed ramp 32 formed by a recess into the exterior surface 33 of the C-shaped member 14 in between opposing raised edges, or as shown, shoulders 34. The ramp 34 in the form of such a recess, extends around all of, or at least the curved area 36 of the C-shaped member 14. This ramp 32 provides a secure positioning of the elastic first portion 17 of the strap 12, in between the raised portions or shoulders 34, such that when the device 10 is in the engagement with the ski equipment as in FIG. 5, the first portion 17 of the strap 12 is located within a recessed pathway 38 (FIG. 3) and will not slide from either side edge of the C-shaped member 14.

Figure 3:
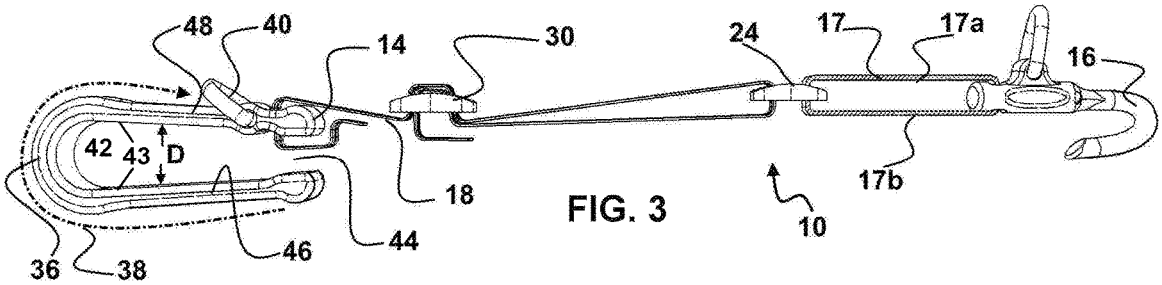
FIG. 3 shows a side view of the device of FIGS. 1-2 and also showing a pathway by a recess formed on an exterior surface of the C-shaped member which is configured for a biased positioning of the elastic second portion of the strap therein to an engaged position, with the clip removably engaged to the connector on the C-shaped member as shown in FIG. 5.

FIG. 3 shows a side view of the device of FIGS. 1-2 and also showing the recessed pathway 36 defined by the ramp 32 which is recessed into the exterior 33 surface of the C-shaped member 14. As can be seen, in moving to the engagement of the device 10 as shown in FIG. 5, the clip 16 is engaged to a clip connector 40, and pulls and stretches the elastic first portion 17 of the strap 12, which locates into the recess provided by the ramp 32. As shown, the recess forming the ramp 32 is located in between the opposing raised side edges or shoulders 24 formed on the exterior 33 surface of the C-shaped member 14. The recess into the exterior surface of the C-shaped member forming a ramp 32 is preferred as it maintains the biased contact of the elastic first portion 17 of the strap 12, within and against the surface of the ramp 32, which extends around the curved area 36.

To achieve the removable engagement with ski equipment to which the device 10 is adapted, when the device 10 is circumferentially engaged around two contacting adjacently positioned skis 20, as in FIG. 5, the clip 16 is pulled to stretch the first portion 17 of the strap 12, which settles into the recess and on the surface of the ramp 32, as the clip 16 is engaged to the clip connector 40. The biasing force exerted by the stretched elastic first portion 17 of the strap 12 is communicated to the second portion 18 of the strap 12, which frictionally contacts against portions of exterior surface of the two skis 20. The contact against the surfaces of the two adjacent skis holds the skis 20 in position relative to each other, and also holds the device 10 in a fixed position encircling both skis 20.

As shown in FIG. 4 the portion of the strap 12 formed of elastic material, can include the entire length of the strap 12. In this mode, as can be discerned, the elastic material is formed by a first section 17*a* extending between the engagement to the clip 16 and the C-shaped member 14. The second section 17*b* (not shown) will extend from the clip 16 to the adjustment member 30.

As noted, FIG. 5 shows the device 10 of FIGS. 1-4, positioned in an engaged position with ski equipment such as two skis 20 adjacent and in contact with each other, and one or a plurality of poles 22. As shown in FIG. 5 and FIGS. 1 and 3 herein, a pole clamping area is formed by an opening 42 formed between opposing sides of the C-shaped member 14, and a passage 44 provides access for the poles 22 into and out of the opening 42.

With the device 10 in the engaged position of FIG. 5, a portion of the strap 12 encircling the skis 20, is positioned to block the passage 44 and thereby maintain the poles 22 within the opening 42 as long as the device 10 is located to the engaged position. Ski poles 22 as is well known, conventionally have handles on one end opposite a tip on the other end. At the tip end, what is known as a basket which is the disc like object just above the tip, surrounds the pole and is so positioned to stop the ski pole from sinking too far into the snow. Also well known and not shown are loops located on each handle of ski poles to secure them to the wrists of the user.

As shown, with the diameter of the opening 42 being substantially equal to that of the poles 22 to which the opening 42 is adapted to encircle, or at least smaller than a diameter of the handle and/or the basket on the poles 22, the poles 22 cannot slide out of opening 42 along the axis of the poles 22. Further, with the strap 12 blocking the passage 44, the poles 22 cannot move out of the opening 42 through the passage 44. Additionally, as noted, one or both of the ski handle loops may first be engaged to encircle both skis to provide an engagement of the handle ends of the poles to the skis to hold the poles 22 substantially parallel to the skis 20 when the device 10 is in the engaged position of FIG. 5.

As such, with the device 10, in the engaged position of FIG. 5, it is held in a substantially fixed engagement at a mounting position on the skis 20 which are encircled by the strap 12, and the poles 12 are held within the opening 42 by the blocking of the passage 44 by the encircling strap 12. Thus, the user may hold the poles 22, and thereby carry the skis 20 comfortably and easily with one hand.

Further, while the C-shaped member 14 may be formed of metal or polymeric or other material having the strength and durability to handle the ongoing engagement with ski equipment, in another preferred mode, the material forming the C-shaped member is sufficiently flexible to allow a deflection and move one or both of a first member section 46 on one side of the passage 44 and a second member section 48 on the opposing side of the passage 44 closer to each other. This deflection will narrow the gap forming the passage 44 and will also narrow a diameter D (FIG. 3) of the opening 42 which is situated in between the first member section 46 and second member section 48.

The narrowing of the diameter D of the opening 42, causes the first member section 46 and/or second member section 48, to deflect, and thereby form a compressive engagement with sides of the poles 22 located within the opening 42 with an interior surface 43 forming the opening 42. This forms a more secure engagement with the poles 22 to which the device 10 is adapted to removably engage along with the skis 20.

While all of the fundamental characteristics and features of the removably engageable ski equipment securement device have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A ski equipment securement apparatus, comprising:

a substantially C-shaped member having a body, said body having a first member section and a second member section;

said second member section extending from a first end of said body, to a curved area of said body;

said first member section extending from said curved area to a distal end thereof;

said body having an exterior surface opposite an interior surface;

said interior surface defining an opening situated between said first member section and said second member section, said opening accessible through a passage located in-between said distal end of said first member section and said second member section;

a strap, said strap in a connection at a first end thereof, with said first end of said body;

a second end of said strap in a connection to a clip;

a clip connector positioned at or adjacent said first end of said strap;

a curved pathway extending upon said exterior surface of said body upon said first member section thereof and around said curved portion thereof and upon said second member section thereof;

said clip positionable to a removable engagement with said clip connector;

a side surface of said strap contacting said curved pathway with said clip in said removable engagement;

a blocking portion of said strap positioned across said passage, with said clip in said removable engagement;

said C-shaped member adapted for positioning to an engaged position thereof with at least one ski pole positioned within said opening, and with said clip in said removable engagement with said clip connector, to thereby hold said strap in an encircling contact thereof against exterior surfaces of a pair of skis, whereby a said pole within said opening is prevented from removal through said passage by said blocking portion of said strap, and is employable as a handle to carry said skis while said C-shaped member is in said engaged position.

2. The ski equipment securement apparatus of claim 1, additionally comprising:

a recess formed in said exterior surface of said body of said C-shaped member, said recess located along said curved pathway; and said contact of said side surface of said strap with said exterior surface of said body along said pathway, being within said recess.

3. The ski equipment securement apparatus of claim 1, additionally comprising:

said strap having a first portion, and having a second portion formed of elastic material;

said elastic material imparting compression to said encircling contact of said strap with said exterior surfaces of said pair of skis to form a compressive encircling contact thereof with exterior surfaces of a pair of skis.

4. The ski equipment securement apparatus of claim 2, additionally comprising:

said strap having a first portion, and having a second portion formed of elastic material;

said elastic material forming a biased said side surface contact with said exterior surface of said body within said recess; and said elastic material during imparting compression to said encircling contact of said strap with said exterior surfaces of said pair of skis to form a compressive encircling contact thereof with exterior surfaces of a pair of skis.

5. The ski equipment securement apparatus of claim 1, additionally comprising:

said body of said C-shaped member being formed of pliable material; and movement of said first member section toward said second member section with said C-shaped member in said engaged position, imparting a compressing contact of said interior surface defining said opening against exterior surfaces of a ski pole therein.

6. The ski equipment securement apparatus of claim 2, additionally comprising:

said body of said C-shaped member being formed of pliable material; and movement of said first member section toward said second member section with said C-shaped member in said engaged position, imparting a compressing contact of said interior surface defining said opening against exterior surfaces of a ski pole therein.

7. The ski equipment securement apparatus of claim 3, additionally comprising:

said body of said C-shaped member being formed of pliable material; and movement of said first member section toward said second member section with said C-shaped member in said engaged position, imparting a compressing contact of said interior surface defining said opening against exterior surfaces of a ski pole therein.

8. The ski equipment securement apparatus of claim 4, additionally comprising:

said body of said C-shaped member being formed of pliable material; and movement of said first member section toward said second member section with said C-shaped member in said engaged position, imparting a compressing contact of said interior surface defining said opening against exterior surfaces of a ski pole therein.

9. The ski equipment securement apparatus of claim 2, additionally comprising:

said recess defined by ribs positioned on opposing sides of said recess along said curved pathway.

10. The ski equipment securement apparatus of claim 4, additionally comprising:

said recess defined by ribs positioned on opposing sides of said recess along said curved pathway.

11. The ski equipment securement apparatus of claim 6, additionally comprising:

said recess defined by ribs positioned on opposing sides of said recess along said curved pathway.

12. The ski equipment securement apparatus of claim 8, additionally comprising:

said recess defined by ribs positioned on opposing sides of said recess along said curved pathway.

13. The ski equipment securement apparatus of claim 3, additionally comprising:

said second portion of said strap formed of a first section of elastic material engaged between a connection point with said first portion of said strap and said clip, and a second section of elastic material engaged between said connection point and said clip.

14. The ski equipment securement apparatus of claim 4, additionally comprising:

said second portion of said strap formed of a first section of elastic material engaged between a connection point with said first portion of said strap and said clip, and a second section of elastic material engaged between said connection point and said clip.

15. The ski equipment securement apparatus of claim 6, additionally comprising:

said second portion of said strap formed of a first section of elastic material engaged between a connection point with said first portion of said strap and said clip, and a second section of elastic material engaged between said connection point and said clip.

16. The ski equipment securement apparatus of claim 7, additionally comprising:

said second portion of said strap formed of a first section of elastic material engaged between a connection point with said first portion of said strap and said clip, and a second section of elastic material engaged between said connection point and said clip.

17. The ski equipment securement apparatus of claim 8, additionally comprising:

said second portion of said strap formed of a first section of elastic material engaged between a connection point with said first portion of said strap and said clip, and a second section of elastic material engaged between said connection point and said clip.

18. The ski equipment securement apparatus of claim 10, additionally comprising:

said second portion of said strap formed of a first section of elastic material engaged between a connection point with said first portion of said strap and said clip, and a second section of elastic material engaged between said connection point and said clip.

19. The ski equipment securement apparatus of claim 11, additionally comprising:

said second portion of said strap formed of a first section of elastic material engaged between a connection point with said first portion of said strap and said clip, and a second section of elastic material engaged between said connection point and said clip.

20. The ski equipment securement apparatus of claim 12, additionally comprising:

said second portion of said strap formed of a first section of elastic material engaged between a connection point with said first portion of said strap and said clip, and a second section of elastic material engaged between said connection point and said clip.

* * * * *